United States Patent [19]

Conklin, Jr.

[11] Patent Number: 4,602,548

[45] Date of Patent: Jul. 29, 1986

[54] TONE COMPENSATOR FOR PIANO SOUNDBOARDS

[75] Inventor: Harold A. Conklin, Jr., Cincinnati, Ohio

[73] Assignee: Baldwin Piano & Organ Company, Cincinnati, Ohio

[21] Appl. No.: 747,656

[22] Filed: Jun. 21, 1985

[51] Int. Cl.[4] ..... G10C 3/04

[52] U.S. Cl. ..... 84/209; 84/212

[58] Field of Search ..... 84/189, 212, 216, 234, 84/209

[56] References Cited

U.S. PATENT DOCUMENTS 486,013 11/1892 Wuest, Jr. ..... 84/192

962,393 6/1910 Sheldon ..... 84/192

FOREIGN PATENT DOCUMENTS 1157715 7/1969 United Kingdom ..... 84/209

*Primary Examiner*—Benjamin R. Fuller

*Attorney, Agent, or Firm*—Frost & Jacobs

[57] ABSTRACT

A small mass having a weight within the range of from about 50 grams to about 200 grams is utilized in an upright or grand piano to minimize or eliminate a difference in tonal amplitude and/or decay rate between at least two notes produced by playing at least two adjacent piano keys. The difference in tonal amplitude and/or decay rate may occur in a small group or region of notes produced by adjacent keys, or at those notes of adjacent keys located at certain natural scale "breaks". The mass is affixed to that soundboard bridge on which the note demonstrating the greatest amplitude and/or decay rate terminates vibrationally and is located adjacent the at least one string of that note.

14 Claims, 15 Drawing Figures

9
9
10
11
12
16
17
18
7a
7a
7b
7b
8
8
1
5
6
20
19
2
7a
7b
4
8
21
7a
7b
8

TONE COMPENSATOR FOR PIANO SOUNDBOARDS

TECHNICAL FIELD

The invention relates to piano soundboards and soundboard bridges, and more particularly to the use of a small mass in association with a soundboard bridge to improve tonal uniformity from note to note.

BACKGROUND ART

The present invention is applicable either to grand or to upright mechano-acoustic pianos having tone-generating elements in the form of struck strings made of steel core wire streched under tension. The strings may be either plain or wrapped with one or more layers of covering wire, each layer encircling the core wire in the form of a multi-turn helix. The piano usually has 88 notes, a key for each note, a hammer for each note and a compass spanning at least the frequency range from the note A0=27.5 Hz to the note C8=4186 Hz. It is the purpose of the invention to improve the tonal uniformity of the piano by eliminating or minimizing a tonal discontinuity common to many pianos. This defect is an undesirable difference in tonal amplitude and/or duration between the tones produced by playing adjacent piano keys. This usually occurs at certain natural scale "breaks" but may also occur within other small regions or groups of notes produced by adjacent keys or at certain natural scale "breaks". While not intended to be so limited, the invention will be described in terms of the elimination or minimization of a tonal discontinuity noticeable when playing adjacent keys which correspond to string locations on either side of the "bass break".

It is well known that the design of the soundboard and bridge structure of a piano is of primary importance in determining the tone quality of the instrument. However, the exact ways in which the soundboard and bridges influence tone quality often have not been fully understood. In the past it has sometimes happened that excellent results have been achieved as much from luck as from design, or that less than satisfactory results have been tolerated because the source of the trouble could not be identified. It has been found that modern digital electronic equipment and analysis techniques can contribute greatly to an understanding of the influence of soundboard construction upon the musical performance of the finished instrument. In the case of the present invention, attention was directed toward increasing the uniformity of tone quality of the notes on either side of the natural scale discontinuity usually referred to as the "bass break." The bass break is the demarcation between those notes whose strings are terminated vibrationally on the treble bridge and those notes whose strings are terminated vibrationally on the bass bridge. Again for purpose of an exemplary showing, the invention will be described in connection with an upright piano.

The use of small masses or weights in association with piano soundboards is not new in and of itself. For example, U.S. Pat. No. 486,013 teaches the use of a plurality of graduated weights affixed to a thick soundboard to increase its vibration. U.S. Pat. No. 962,393 describes improving the tone of pianos by affixing a pair of mushroom-shaped weights to the soundboard, the lighter one of the pair of weights being affixed to the soundboard back of the treble strings and the heavier one of the weights being affixed to the soundboard back of the bass strings.

The invention is based on the discovery that a tonal difference between the notes of adjacent keys, as at the bass break, can be minimized by the appropriate mounting of a small mass or weight on one of the soundboard bridges, as will be explained hereinafter.

DISCLOSURE OF THE INVENTION

According to the invention a small mass or weight is employed in an upright or grand piano to minimize or eliminate a tonal discontinuity in the form of an undesirable difference in timbre between at least two notes produced by playing at least two adjacent piano keys. The mass is affixed to that soundboard bridge on which the note of said at least two notes, demonstrating the greater amplitude or decay rate, terminates vibrationally. The weight is located adjacent the at least one string of the last mentioned note.

The mass may be located on that side of the soundboard opposite the soundboard bridge, being attached to the soundboard and soundboard bridge by appropriate means. Alternatively, the mass may be attached directly to the bridge, on that side of the bridge on which the strings terminate vibrationally. The mass has a weight within the range of from about 50 grams to about 200 grams.

DETAILED DESCRIPTION OF THE INVENTION

Figure 1A:
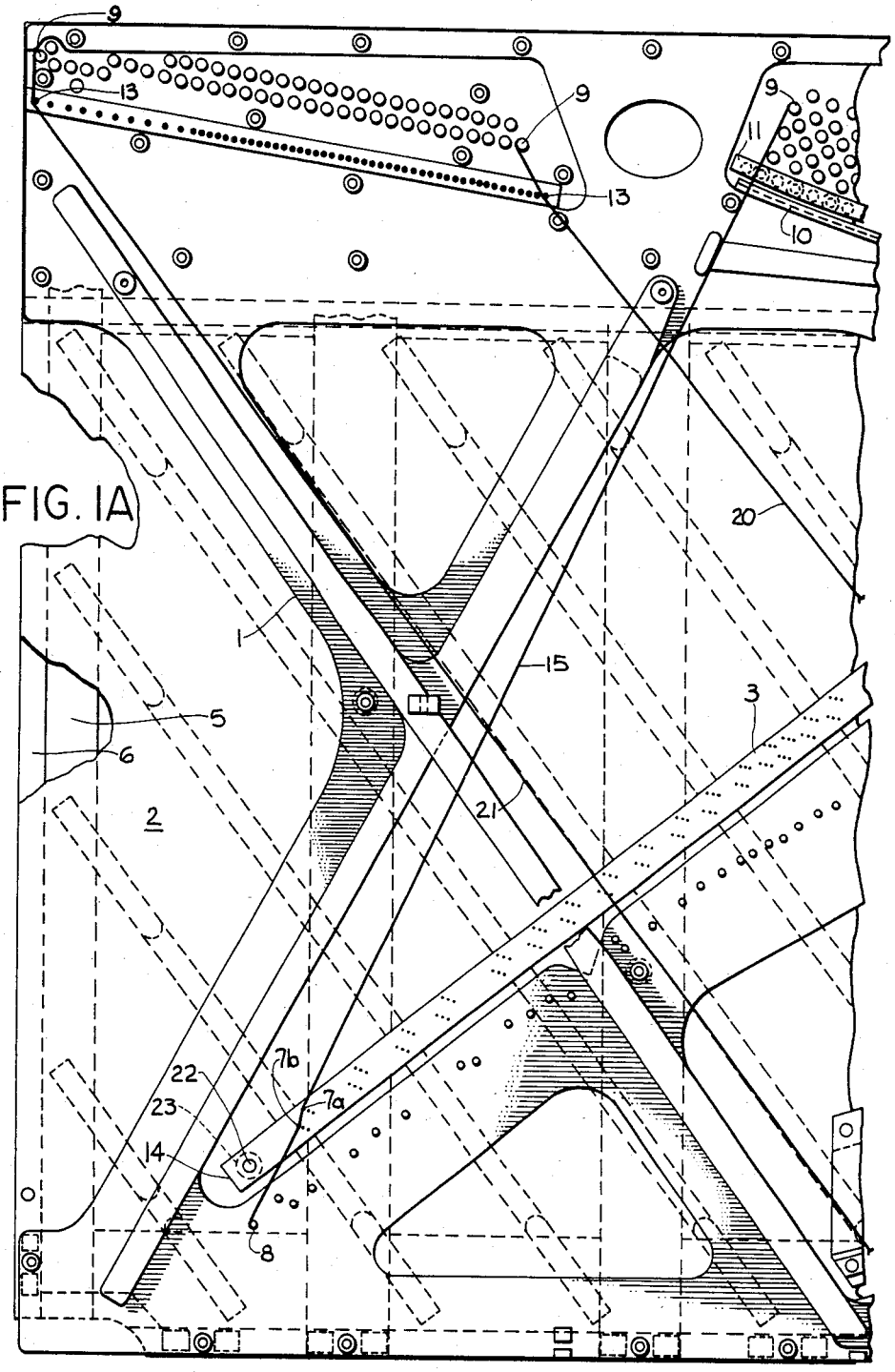
FIGS. 1A and 1B constitute a front elevational view of the string plate, sound board and back of an upright piano.
Figure 1B:
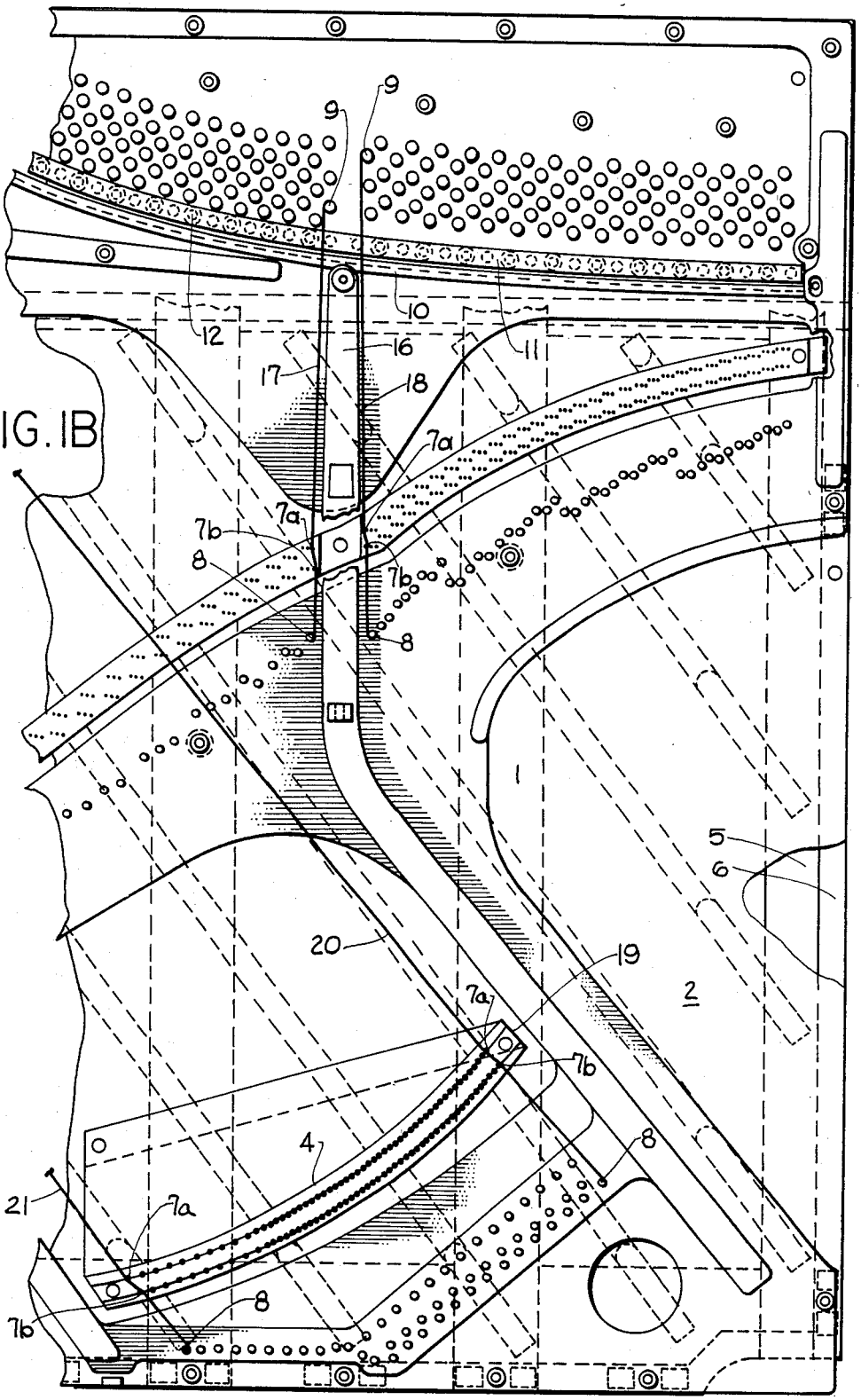

Reference is first made to FIGS. 1A and 1B which is a front elevational view of the interior of an upright piano, the general features of which will be familiar to those well acquainted with piano construction. The string plate or "plate" is indicated at 1. The soundboard is shown at 2. Attached to the soundboard are the soundboard bridges, typically two in number, which are shown at 3 and 4. The longer bridge at 3 is usually called the treble bridge. The shorter bridge at 4 is called the bass bridge. The soundboard and its bridges usually are made of wood. The soundboard itself normally is made from a softwood such as spruce, while the bridges usually are made from a hardwood such as maple or beech. The soundboard of an upright piano normally is glued all around its perimeter onto a heavy wooden framework called the "back". In FIGS. 1A and 1B the back is indicated at 5. The edges of the back have raised wooden strips, indicated at 6, to which the edges of the soundboard are glued.

One end of the speaking length of each piano string is terminated vibrationally at one or the other of the bridges 3 and 4 by being deflected around a pair of nail-like metal bridge pins, *7a* and *7b*, which are driven into holes drilled in the top surface of the bridge. Although terminated vibrationally at its respective bridge, each string continues across and below the bridge to one of a number of hitch pins mounted on the string plate 1 and indicated at 8, to which it is anchored by a loop around the pin or by other means. The hitch pin supports the tension load at the lower of the string. At its extreme upper end each string is coiled around a tuning pin, to which it is fastened by a simple, well known method. The locations of some tuning pins are indicated at 9. Tension is applied to the strings when the piano is assembled and tuned by turning the tuning pins with an appropriate tool. The tuning pins pass through bushed holes drilled in the tuning pin panel portion of the string plate, and behind this, enter into holes drilled in a wooden pin block (not shown). The tightness of fit between the tuning pin and its hole in the pin block is sufficient to maintain the tension placed on the string. Whereas the tuning pin 9 acts as the mechanical termination of a string, it does not serve as the upper vibrational termination of the speaking length of the string. The upper vibrational termination occurs at a deflection point over which the string passes on its way to the tuning pin 9. In an upright piano this deflection point normally takes one of two forms. The first form is a raised, V-shaped ridge cast into the string plate, as indicated at 10 in FIGS. 1A and 1B. Above this ridge the strings pass under a pressure bar, indicated at 11, usually of steel, which is attached to the piano string plate 1 and back 5 by a number of screws 12. The screws function to pull the pressure bar 11 down toward the surface of the spring plate 1, thereby deflecting each piano string and forcing in into intimate contact with the V-ridge 10. The upper vibrational termination of the string occurs at its point of contact with the V-ridge 10. This form is normally used for strings that are associated with the treble bridge 3. In a second form of termination, each string is deflected around a single agraffe pin, indicated at 13, which is pressed into a hole drilled for it at the apex of a ridge that is cast into the string plate 1. After being deflected at the agraffe pin 13, the string continues to its tuning pin 9. This form of termination normally is used for strings that are associated with the bass bridge 4.

In this piano each note of the treble bridge has three strings. The lowest frequency series of notes on the bass bridge is generated by single strings, the remaining notes of the bass bridge each having two strings. In FIGS. 1A and 1B, that string nearest the end 14 of treble bridge 3, constituting one of the three string of the lowest frequency note of the treble bridge, is shown at 15. One string each of the notes near the center of treble bridge 3 to either side of string plate strut 16 are shown at 17 and 18. The one of the two strings of the highest frequency note of bass bridge 4 nearest the end 19 of the bass bridge is shown at 20. Finally, the single string of the lowest frequency note of bass bridge 4 is shown at 21. The remainder of the strings of the piano have been deleted for purposes of clarity.

It will be observed from FIGS. 1A and 1B that strings 20 and 21 (and all of the other strings that terminate vibrationally along bass bridge 4) pass with some clearance over treble bridge 3 and over some of the treble strings, such as string 15.

This is known as overstringing. The strings that terminate on the bass bridge 4, such as strings 20 and 21, normally are referred to as bass strings, and usually are "loaded" by means of helical wrapping of copper or other wire, in order to obtain increased mass per unit length. The primary vibrations of a piano string take place on its "speaking length," which is that portion of the string lying between the bridge and string plate vibrational terminations. In the upright piano illustrated, the speaking length is that length of a string between the V-ridge 10, and the nearest treble bridge pin *7a*, or between an agraffe pin 13 and the nearest bass bridge pin *7a*. The speaking length is the length on which most scale calculations are based. All of the foregoing information is well known to those familiar with the construction of pianos.

In pianos having the type of construction described above, the strings (one of which is shown at 20) of the highest frequency note of bass bridge 4 and the strings (one of which is shown at 15) of the lowest frequency note of treble bridge 3, respond to piano keys that are located immediately adjacent to one another on the keyboard. It is therefore very desirable that these adjacent notes have similar tone quality. However, because the strings of these notes are terminated vibrationally on different bridges (3 and 4) that are located at different places on the soundboard 2, and because the strings are terminated at the very ends of their respective bridges, it often happens that these notes have noticeably different tone quality. Pianists finds this undesirable.

According to the teachings herein, this tonal discontinuity can be alleviated by the addition of a small compensating mass which is attached to one of the bridges of the piano, either to the top face of the bridge against which the strings bear, or to the back side of the soundboard, directly beneath the bridge. In the piano of FIGS. 1A and 1B the compensating mass is attached at a point indicated at 22, near the low frequency end of the treble bridge 3 and adjacent string 15 of the lowest frequency note, note 33, on the bridge. The best value and location for the mass may be determined according to each individual case, but values within the range 50–200 grams have been found to be typical, and the location 22 shown near the end 14 of the treble bridge 3 was appropriate for this particular design. It has been discovered that a properly selected and located compensating weight 23, such as described, can regulate the vibrational amplitude and decay rate of those strings that are attached to the treble bridge 3 near its low frequency end 14 so that these parameters will best match those of the strings of the adjacent keyboard note which are terminated vibrationally at the high frequency end 19 of the bass bridge 4. The result, when a proper match is achieved, will be to minimize difference in tone quality between the lowest frequency note on the treble bridge 3, in this case Note 33, and the highest frequency note on the bass bridge 4, Note 32.

FIGS. 2A, 2B, 3A, 3B, 4A, 4B, 5A, 5B, 6A and 6B illustrate the effectiveness of the tone compensating mass. Each pair of FIGS. 2A–2B, 3A–3B, 4A–4B, 5A–5B and 6A–6B presents two curves, each curve showing the variation of sound pressure level (SPL) of a different piano tone as a function of time. In each pair of figures the first graph shows the SPL at the fundamental frequency of Note 33, which is F3, nominally at 174.61 Hz. The second graph shows the same information for Note 32, which is E3, with a nominal frequency of 164.81 Hz. The vertical axis of each graph represents the value of SPL in decibels, and the horizontal axis gives the time in seconds after a note has been sounded. The sound level was measured with a standard microphone which remained at a constant distance from the test piano for all the curves. It will be remembered that although the keys of these notes are adjacent on the keyboard, their strings are attached to different bridges. The strings of Note 32 terminate vibrationally near the end 19 of bass bridge 4, while the strings of Note 33 terminate vibrationally near the end 14 of treble bridge 3. Notes 32 and 33 are, therefore, on opposite sides of the bass break of this piano. No changes were made in the equipment or in the tuning of the piano during the tests. The only thing that was changed was the value of the compensating mass.

Figure 2A:
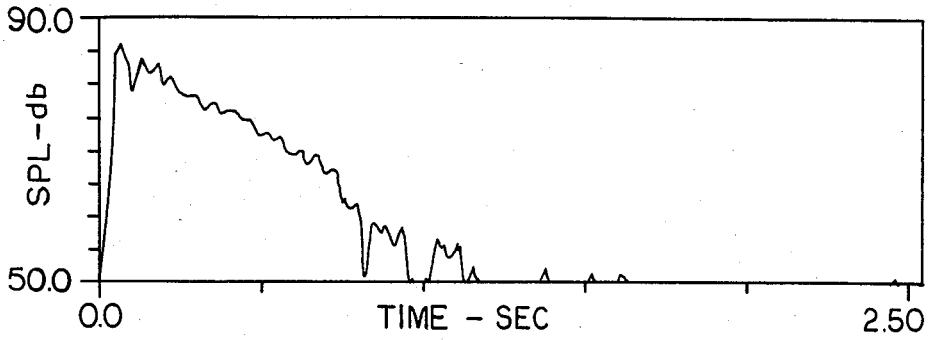
FIG. 2A is a graph illustrating the sound pressure level in decibels as a function of time in seconds at the nominal fundamental frequency (174.61 Hz) of the lowest frequency string of the treble bridge with no compensating mass.
Figure 2B:
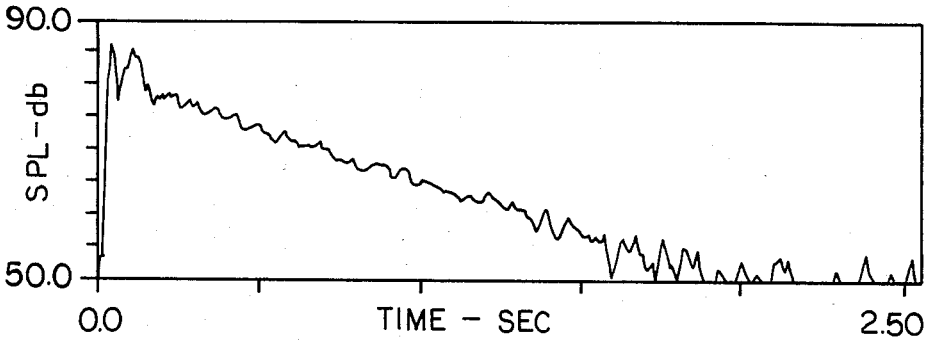
FIG. 2B is a graph illustrating the sound pressure level in decibels as a function of time in seconds at the nominal fundamental frequency (164.81 Hz) of the highest frequency string on the bass bridge with no compensating mass.
Figure 3A:
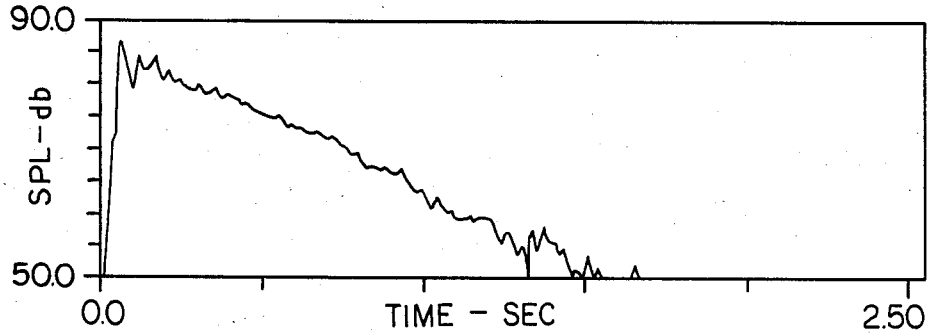
FIGS. 3A and 3B are similar graphs for the same strings employing a compensating mass of 50 grams.
Figure 3B:
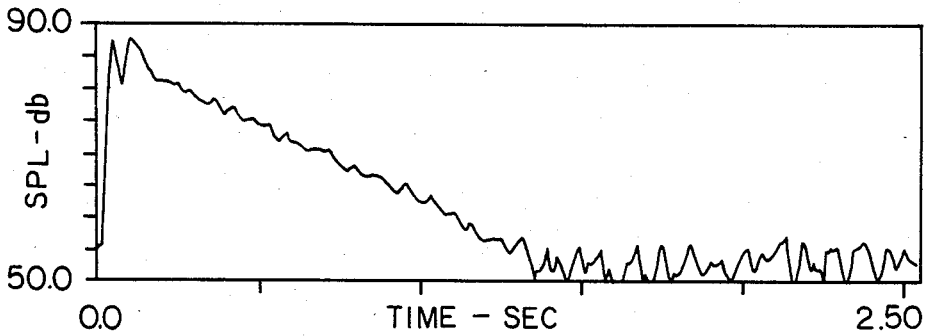
Figure 4A:
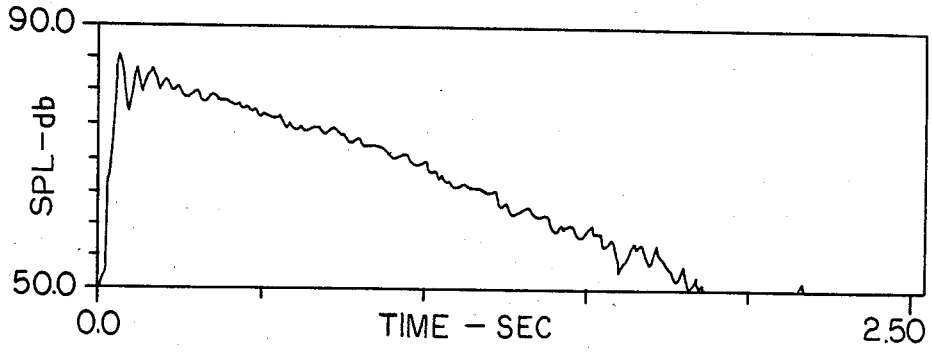
FIGS. 4A and 4B are similar graphs for the same strings employing a compensating mass of 98 grams.
Figure 4B:
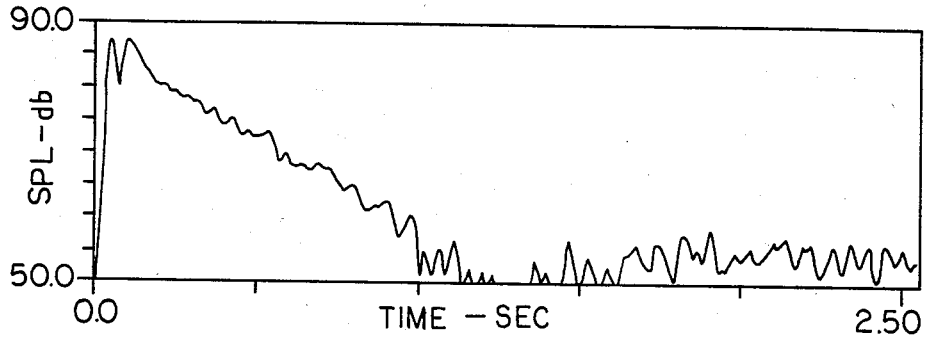
Figure 5A:
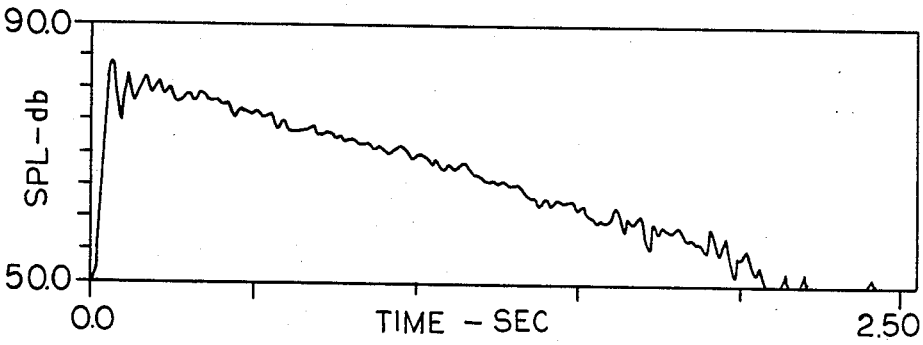
FIGS. 5A and 5B are similar graphs for the same strings employing a compensating mass of 140 grams.
Figure 5B:
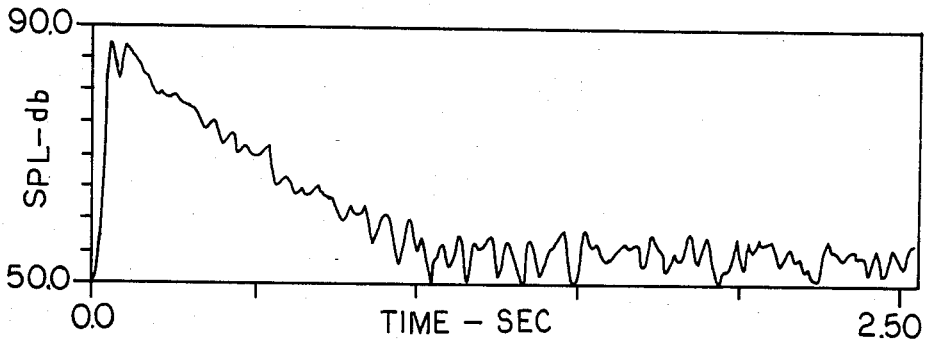
Figure 6A:
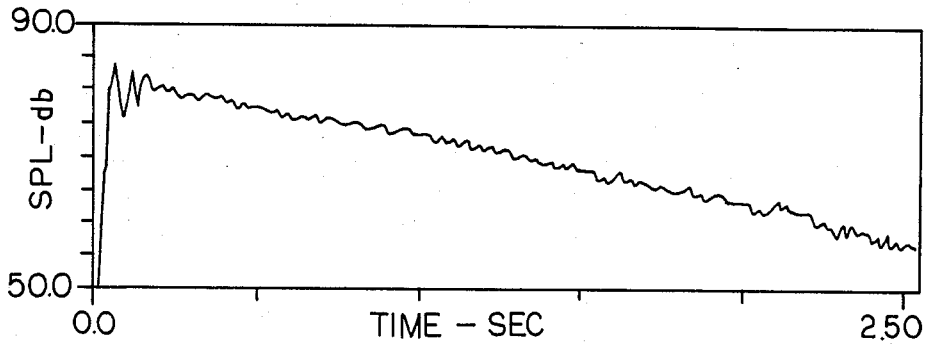
FIGS. 6A and 6B are similar graphs for the same strings employing a compensating mass of 200 grams.
Figure 6B:
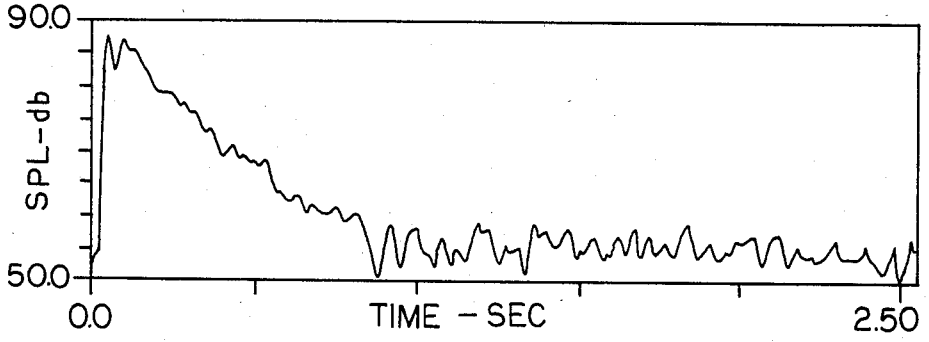

FIGS. 2A and 2B show the results with no compensating mass. It will be seen that the curve of FIG. 2A, representing Note 33 has somewhat greater initial amplitude than the curve of FIG. 2B representing Note 32 and that the SPL diminishes much more rapidly, reaching 50 db within about one second, compared with about two seconds for the curve of FIG. 2B. FIGS. 3A and 3B show the results for a compensating mass of 50 grams. In this case the two curves rise to about the same initial level and appear to be essentially identical in slope, with sound levels diminishing to 50 db in about 1.5 seconds. FIGS. 4A and 4B gives the results for a 98 gram mass. In FIG. 4A the curve representing Note 33 has a lower initial level and diminishes more slowly than the curve of FIG. 4B for Note 32, which reaches the 50 db level after only about 1.3 seconds as opposed to 1.8 seconds for Note 33. FIGS. 5A–5B and 6A–6B give the results with compensating masses of 140 and 200 grams, respectively. In these tests Note 33 died away still more slowly and had a further decreased initial level compared with Note 32.

Based on these curves, the correct mass to compensate the fundamental or first partial of these notes would be 50 grams, for which both the initial amplitudes and decay rates of the notes were regulated to be nearly identical. It is noteworthy that the complete soundboard and bridge assembly for the piano that was being tested weighed approximately 9 kg. Compensation was therefore achieved in this instrument with an additional mass representing only 50/9000 or about 0.55 percent of the weight of the soundboard assembly.

In practice, of course, the first partial is not the only significant one. It follows that equality of the amplitudes and durations of the first partials of the notes on either side of the bass break may not necessarily be the most useful criterion for determining the best amount of compensation to use in a particular piano. In practice it may be more important to equalize higher ordered partials. In the production version of the instrument employed in the tests just described, a 96-gram compensator was employed. Based upon the test results given above, the final 96-gram value was selected subjectively by listening to the piano.

Figure 7A:
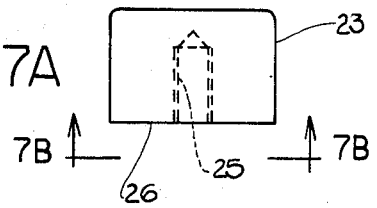
FIG. 7A is an elevational view of an exemplary compensating mass of the present invention.
Figure 7B:
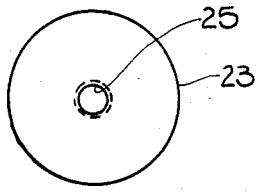
FIG. 7B is a plan view of the compensating mass of FIG. 7A.
Figure 8:
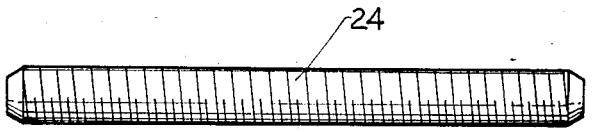
In FIG. 8 is an elevational view of an exemplary mounting stud for the compensating mass of FIGS. 7A and 7B.

As was true of the tone compensating weights used in the tests outlined above, the compensating weight 23 of the present invention (see FIGS. 7A and 7B) is preferably made of brass round stock 2.86 cm ($1\frac{1}{8}$ inches) in diameter. The weight is attached to the back of the soundboard, directly under the center of the treble bridge at point 22 in FIGS. 1A and 1B. Attachment to the soundboard/bridge is accomplished by means of a 10–24 NC threaded stud 24 (see FIG. 8), screwed tightly into the soundboard 2 and bridge 3 and allowed to protrude on the rear side of the soundboard. The compensating weight 23, which is made with a threaded hole 25 in its center that matches the threads of the stud 24, was then threaded onto the stud 24 until the flat surface 26 of the weight was in intimate contact with the rear side of the soundboard 2. The weight 23 also could have been installed on same side of the bridge as the strings in substantially the same manner.

While the invention as been described in connection with a specific tonal problem, namely a discontinuity which frequently occurs at the bass break of pianos, and while the compensator was placed very near to the end 14 of the treble bridge 3 in order to deal most effectively with that problem, the use of a compensating mass is not limited ot this application alone or to that particular location. A compensating mass may be employed beneficially at other locations on or beneath piano bridges. For example, if, in the case of the instrument previously described, Note 32 at the end of the bass bridge 4 has been the one having greater initial amplitude and lesser duration of tone compared with Note 33, then the compensating mass might have been placed on or under the bass bridge 4, near the strings of Note 32.

The function of the compensating mass is broadly to increase the mechanical impedance at and near the part of the instrument to which it is attached. The result of adding a mass generally will be that a given value of force applied at or near the compensating mass (as for example a complex alternating force due to the vibration of a piano string) will produce a smaller motion with the mass in place than without the mass. If the driving force comes from a vibrating piano string, the result generally will be a reduction in the amplitude of bridge motion produced by that string force, with a consequent decrease in tonal loudness. Accompanying this there may be an increase in tonal duration due to the reduced rate of dissipation of energy from the string. The effect of the added mass will generally be greatest in the vicinity of the mass itself. If placed on or under a piano bridge, therefore, it will usually have the greatest effect on those strings that are connected to the bridge at points nearest the mass. However, the entire bridge and soundboard assembly of a piano must be regarded as a coupled mechanical system within which all of the parts are interconnected in a relatively complex way. Therefore, the effect of adding a mass at a particular location cannot be purely local.

A mass added at a particular point within the system will have a system-wide effect. The curves of FIGS. 2A through 6B show, for example, that the addition of a compensating mass at point 22 on the end 14 of the treble bridge 3 did not affect only the amplitude and decay rate of the Note 33, which had strings terminated immediately adjacent on the treble bridge 3. Observe that the amplitude and decay rate of Note 32 on the bass bridge 4 were also affected, though to a somewhat lesser extent than Note 32. Notice also that while the duration of Note 33 became greater with the addition of mass, and while its amplitude became less, Note 32, with strings terminated on the end of the bass bridge, was affected in exactly the opposite direction: its amplitude generally became greater and its duration generally became less when the mass at 22 was increased. If a mass is placed on a part of the instrument that exhibits prominent vibrational modes at particular frequencies, the effect of the mass may be to shift the frequencies of the modes. It is apparent, therefore, that the effect of adding a lumped mass to a complex mechanical system will not necessarily be the same at all frequencies.

The teachings of the present invention may be applied to other "breaks" in the instrument, as for example at the highest frequency end of treble bridge 3 and the lowest frequency end of bass bridge 4 where impedence discontinuities can occur, or between strings 17 and 18 of the treble bridge which are separated from each other by a distance sufficient to make way for string plate strut 16. In some instruments at such a position on the treble bridge 3, the bridge may require notching to accommodate strut 16.

In some instances, particularly in those strings having vibrational terminations on the treble bridge there may be "regions" or groups of a small number of adjacent strings demonstrating amplitudes unacceptably high and durations unacceptably short. Under such circumstances, an appropriate tone compensationg mass may be mounted on the bridge 3/soundboard 2 adjacent the string demonstrating the greatest amplitude and/or shortest duration.

Modifications may be made in the invention without departing from the spirit of it.

What is claimed is:

1. In a piano of the type having a soundboard with a treble bridge and a bass bridge mounted thereon, a string plate and a plurality of tone generating elements comprising strings under tension having a first vibrational termination on said string plate and a second vibrational termination on one of said bridges, a plurality notes, a key for each note and at least one of said strings for each note, a difference in tonal amplitude and/or decay rate between at least two notes produced by playing at least two adjacent keys, a compensating weight affixed to that one of said treble and bass soundboard bridges providing a vibrational termination for said at least one string of that one of said at least two notes which demonstrates the greater amplitude and/or decay rate, said weight being mounted on said last mentioned bridge near said last mentioned at least one string.

2. The piano claimed in claim 1 wherein said weight is a metallic member having a value of from about 50 grams to about 200 grams.

3. The piano claimed in claim 1 wherein said at least two notes have strings terminating vibrationally on said treble bridge.

4. The piano claimed in claim 1 wherein said at least two notes have strings terminating vibrationally on said bass bridge.

5. The piano claimed in claim 1 wherein said difference in tonal amplitude and/or decay rate occurs with adjacent keys located at a natural scale break.

6. The piano claimed in claim 1 wherein said difference in tonal amplitude and/or decay rate occurs between the lowest frequency note of said treble bridge and the highest frequency note of said base bridge.

7. The piano claimed in claim 2 wherein said weight is affixed to the rear surface of said soundboard behind said one of said treble and bass bridges.

8. The piano claimed in claim 2 wherein said weight is affixed to the rear surface of said soundboard behind said one of said treble and bass bridges by means passing through said soundboard and into said one of said treble and bass bridges.

9. The piano claimed in claim 2 wherein said weight is affixed directly to said one of said treble and bass bridges.

10. The piano claimed in claim 5 wherein said natural scale break occurs at that end of said treble bridge on which the at least one string of the highest frequency note terminates vibrationally.

11. The piano claimed in claim 5 wherein said natural scale break occurs at that end of said bass bridge on which the at least one string of the lowest frequency note terminates vibrationally.

12. The piano claimed in claim 6 wherein said weight is affixed to the end of said treble bridge adjacent said at least one string of said lowest frequency note thereof.

13. The piano claimed in claim 6 wherein said weight is affixed to the end of said bass bridge adjacent said at least one string of said highest frequency note thereof.

14. The piano claimed in claim 12 wherein said weight has a value of about 96 grams.

* * * * *